United States Patent [19]

Romero

[11] 4,285,514

[45] Aug. 25, 1981

[54] RAMP DEVICE FOR PRACTICING WHEELED SPORTS

[76] Inventor: Robert Romero, 5018 Granada St., Los Angeles, Calif. 90042

[21] Appl. No.: 115,605

[22] Filed: Jan. 25, 1980

[51] Int. Cl.[3] ..... A63G 31/00

[52] U.S. Cl. ..... 272/3; 14/69.5

[58] Field of Search ..... 272/1, 3; 14/69.5, 9, 14/16; 276/176 B, 176 H; 254/88

[56] References Cited

U.S. PATENT DOCUMENTS

| | | | |
|---|---|---|---|
| 1,232,437 | 7/1917 | Simpson | 14/69.5 |
| 1,855,949 | 4/1932 | Dubroca | 254/88 |
| 2,141,529 | 12/1938 | Gravelle | 14/69.5 |
| 3,663,015 | 5/1972 | Bynder et al. | 272/1 R |
| 3,831,949 | 8/1974 | Henning | 273/176 H |
| 4,121,821 | 10/1978 | Graham | 272/3 |

FOREIGN PATENT DOCUMENTS

| | | | |
|---|---|---|---|
| 939623 | 4/1948 | France | 254/88 |
| 1255035 | 1/1961 | France | 254/88 |

*Primary Examiner*—George J. Marlo
*Attorney, Agent, or Firm*—Erik M. Arnhem

[57] ABSTRACT

A ramp on which bicycle riding, skateboarding, and rollerskating etc. may be practiced comprising two rectangular plates placed in juxtaposition to one another and interconnected by an elongated hinge capable of forming triangularly inclining surfaces having supporting side strips and flaps, or an apertured stick adjustably attachable to projections on the plates to vary the angles of the inclined surfaces for placement on the ground. Jointed knee braces are mounted between the triangular flaps and the underside of the rectangular plates.

2 Claims, 4 Drawing Figures

RAMP DEVICE FOR PRACTICING WHEELED SPORTS

BACKGROUND OF THE INVENTION

1. Field of the Invention

The invention relates to a ramp device, primarily intended for sports people and children, practicing bicycle riding, skateboarding, rollerskating and other wheeled sports on an acrobatic or more daring level.

As will appear from the following brief description of the prior art, various devices have been invented to provide inclined and curved surfaces for the above stated purposes; these, however either feature rather complicated adjustable components or simply, stationary rising surfaces, on which children may exercise their skills with bicycles, etc.

2. Description of the Prior Art

A preliminary search of U.S. patents, in class 272, subclasses 1 and 3, was made, and resulted in finding the following U.S. patents:

U.S. Pat. No. 778,941—Ancilotti, 1905
U.S. Pat. No. 2,225,496—Gethin, 1940
U.S. Pat. No. 2,432,496—Osgood, 1947
U.S. Pat. No. 3,032,343—Freeberg, 1962
U.S. Pat. No. 3,236,520—Friedman, 1966
U.S. Pat. No. 3,341,199—Madsen, 1967
U.S. Pat. No. 3,561,757—Schillig, 1971
U.S. Pat. No. 3,663,015—Bynder et al, 1972
U.S. Pat. No. 4,129,916—Schlesinger et al, 1978

None of the above cited patents discloses a device comparable to Applicant's, namely a two-way adjustable and collapsible ramp device.

By comparison, for example, Bynder et al, describe a one-way bike jump of a fixed nature, having a rising pointedly converging departure zone.

Schlesinger et al, show a curved flexible ramp surface mounted on an adjustable suspensory frame.

SUMMARY OF THE INVENTION

In addition to what is stated under (d) above, the present invention, more particularly concerns a two-way adjustable and foldable ramp device, consisting of two separate merging flexibly inter-connected hard surfaces, provided with supporting means and capable of forming inclined surfaces relative one another for placement on the ground.

One of the underlying purposes of the invention is to develop competitiveness of children and adults, in improving their skills beyond basic bicycle riding, rollerskating, etc.

This purpose is accomplished by mounting the device on the ground with its two inclining surfaces forming a triangle. Depending on the developing capabilities of bike riders or rollerskaters, one may, according to one embodiment of the invention, gradually increase the rising surfaces of the device, as they improve their skills in riding or skating up and down the ramp surface. The ramp device may be used by, e.g., two persons simultaneously and the surfaces may be provided with actual traffic markings for lanes, etc., with double lines, arrows, and so on.

The device, according to the invention, lends itself particularly well to professional practicing of bicycling of rollerskating acrobats.

The ramp device, as described hereinafter in detail, may, when not in use, be folded to a flat shape for packaging or storage.

The ramp device may be set up in a park, backyard, etc., by any person, due to its extremely simple construction.

Thus, it is an object of the invention to provide a two-way ramp device on which to practice various wheeled sports.

It is a further object of the invention to provide such a ramp with adjustable height means, and which is collapsible for easy storage, etc.

It is still a further object of the invention to provide a ramp of such simple construction that it may be manufactured inexpensively and be mounted even by a child.

It is still another object of the invention to provide a safe two-way ramp device, if used as directed.

Further objects and advantages of the invention will appear from the following description.

DESCRIPTION OF THE INVENTION

Figure 1:
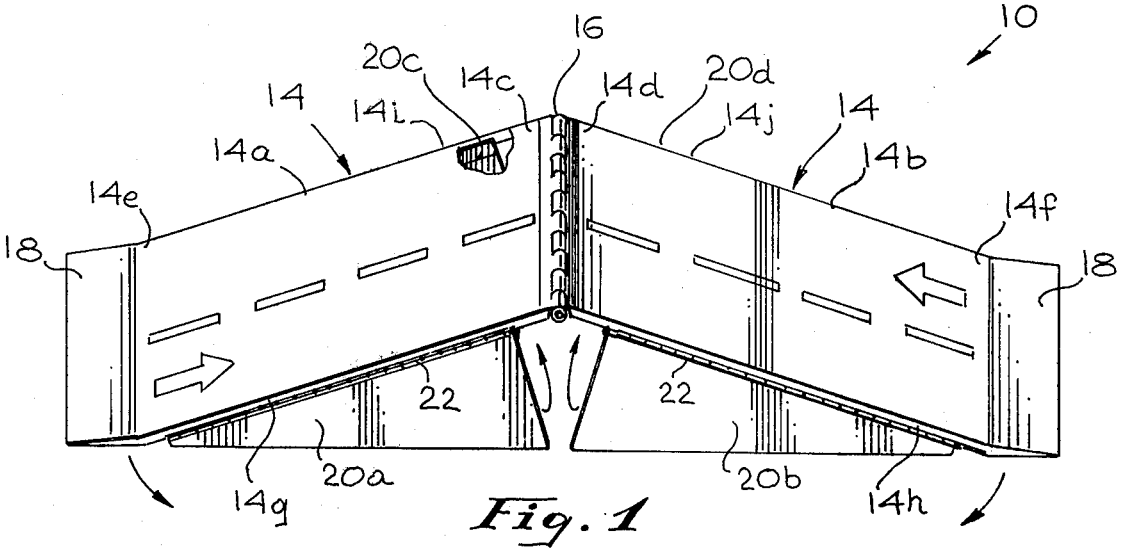
FIG. 1 is a perspective side view of one embodiment of an unfolded ramp device, according to the invention.

Like reference numerals in the drawings designate identical parts illustrated in the several views of the invention.

In FIG. 1, numeral 10 identifies a first embodiment of the ramp device, according to the invention, in which the ramp device comprises ramp members, e.g., two rectangular rigid plates 14, constituting ramp surfaces, respectively 14*a*, 14*b*, two opposite edge portions 14*c* and 14*d* of which are placed in juxtaposition relative one another, and interconnected by flexible means, e.g., a hinge 16 (not shown in detail), extending continuously along the entire lengths of the juxtaposed side edge portions 14*c*, 14*d*, and forming a rounded member, smoothly merging the ramp surfaces 14*a*, 14*b*.

The two lateral edge portions 14*e* and 14*f* of ramp surfaces 14*a*, 14*b*, (oppositely edges 14*c* and 14*d*) teminate, respectively in first supportive means, e.g., a strip 18 extending integrally from or mounted securely to and along edge portions 14*e*, *f* at an angle with the latter.

Second supportive means, e.g., four flaps 20*a, b, c, d* of which two (20*a, b*) are shown in FIG. 1 (flaps 20*c, d* merely being indicated thereon) are affixed, respectively to sides 14*g, h, i* and *j* of the ramp surfaces (of which sides 14*g, h* are visible) by way of flexible means, e.g., hinges 22, similar in construction to hinge 16, interconnecting sides 14*c, d* of the device 10, but preferably of less heavy dimensions.

Ramp surfaces 14*a, b* and flaps 20 are preferably made of rather heavy plastic material of sufficient strength and width to carry the load of several persons and pieces of wheeled equipment. Obviously, one could also use material such as wood, metal, etc., in the manufacture of the components of the ramp device, according to the invention.

Flaps 20 are, as illustrated, preferably of triangular shape, with their bases, respectively so mounted to sides 14*g, h, i* and *j* of the ramp surfaces that their inwardly directed end points stop short of reaching the corners of juxtaposed edge portions 14*c, d* of the ramp surfaces, so as not to interfere with hinge 16 and adjacent areas thereof, when flaps 20 are folded inwardly against the undersides of the ramp surfaces 14*a, b.*

Figure 3:
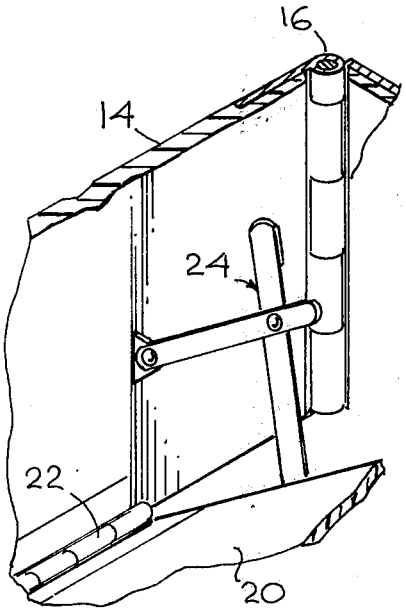
FIG. 3 is a fragmentary perspective view of partially collapsed ramp device of FIG. 1.
Figure 4:
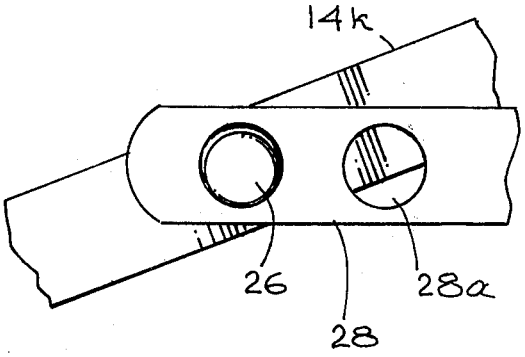
FIG. 4 is a close-up plan view of a detail of the ramp device in FIG. 2.

In order to stabilize flaps 20 in their unfolded state (FIG. 1), jointed knee brace 24 are, respectively mounted diagonally and pivotally to and between the rear surfaces of flaps 20 and the undersides of ramp surfaces 14; when knee brace 24 is aligned, flap 20 will remain in a secure unfolded position, supporting inclining ramp surfaces 14. When flaps 20 are being folded underneath ramp surfaces 14, knee brace 24 will bend inwardly (FIG. 3). The construction of knee braces is well known in the art, and therefore, is not described in detail.

The preferred dimensions of some of the components of the ramp device are stated hereinafter, but, obviously could be modified according to requirements. The choice of an appropriate maximum height at the merging points of inclined ramp surfaces 14*a, b* depends on the selection of the respective angles of the triangular flaps 20, i.e., by arranging the relative magnitudes of the angles to obtain the desired height for the ramp device. The angle formed between strips 18 (if made of rigid material) and sides 14*e, f* of the ramp surfaces would then be set, to conform to the chosen height of ramp surfaces 14*a, b,* providing stable support for the latter; the underside of strips 18 could also be provided with a coat of frictional material to prevent the device, when erected from sliding or moving on location.

Figure 2:
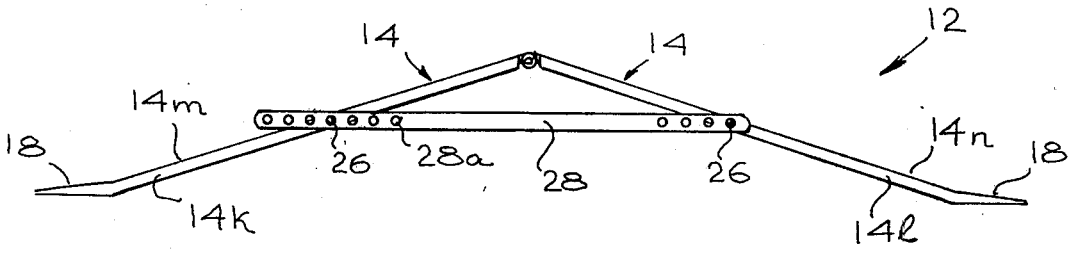
FIG. 2 is a plan side view of a second embodiment of the ramp device.

Another embodiment of the invention is illustrated in FIG. 2, differing in some aspects from the first embodiment, in that flaps 20 have been eliminated and instead, means are introduced to provide a ramp device, designated by numeral 12, the height (from the apex of the device to the ground on which it is placed) of which is adjustable within a wide range of choices; the adjustable features of the second embodiment may enable the user of the device to select an appropriate height for his specific activities, or to gradually raise the height thereof, e.g., when children (or adults) learn, or practice competitively to master increasingly daring oblique positions of ramp surfaces 14.

The device, according to the invention, is then provided with at least two projecting means, e.g., in the form of stemmed buttons 26, respectively extending integrally from, or mounted securely, preferably at identical heights, to appropriate locations on two adjacent end surfaces, e.g., 14*k* and *l*, respectively of ramp 14 (FIG. 2).

An apertured stick 28, provided with a number of apertures 28*a*, having a diameter slightly larger than that of buttons 24, are mountable easily detachable over the latter, and will restrain the flexibly interconnected inclined ramp surfaces 14*a, b* within a selected height position of the ramp device. Stick 28 will then rest securely locked on the stems of buttons 26, because of the outwardly urging of the flexibly interconnected ramp surfaces 14*a, b.* Stick 28 should be made of material of sufficient strength and thickness to withstand any loads placed on surfaces 14*a, b* that would strive to flatten out an angle formed therebetween.

As indicated by the arrows in the drawings, the devices illustrated in FIGS. 1 and 2 may be folded to a flat package for storage, by simply bending flaps 20 underneath the surfaces 14*a, b* of the device, respectively detaching stick 28 from buttons 26.

The preferred dimensions of the basic components of the device, according to the invention, are as follows:

Width of ramp surfaces 14*a, b* (respectively): 17½"
Height of flaps 20 (respectively): 14½"
Total length of surfaces 14*a, b* (respectively): 48"
Length of flaps 20 (respectively): 7½"

A number of units of the ramp device, according to the invention, could be joined or placed together to give a hill-and-valley effect to cyclists and rollerskaters, etc.

While the foregoing has illustrated and described what is now contemplated to be the best mode of carrying out the invention, the latter is, of course, subject to modifications without departing from the spirit and scope of the invention.

Therefore, it is not desired to restrict the invention to the particular constructions illustrated and described, but to cover all modifications, that may fall within the scope of the appended claims.

I claim:

1. A ramp device for practicing wheeled sports thereon, comprising:

(a) A plurality of rectangular plates of rigid material, edge portions of which are arranged in juxtaposition to each other;

(b) a continuous hinge, extending connectively along and between the juxtaposed edge portions of the rectangular plates;

(c) triangularly shaped flaps of rigid material, one edge portion of which is connected hingedly and supportively to oppositely extending edge side portions of the rectangular plates, respectively, whereby the rectangular plates may be placed stationarily in inclined positions relative to each other.

2. A ramp device, according to claim 1, wherein jointed knee braces are, respectively pivotably mounted to and between the rear sides of the flaps and the underside of the rectangular plates.

* * * * *